US005116487A

United States Patent [19]

Parekh et al.

[11] Patent Number: 5,116,487

[45] Date of Patent: May 26, 1992

[54] FROTH FLOTATION METHOD FOR RECOVERY OF ULTRA-FINE CONSTITUENT

[75] Inventors: Bhupendra K. Parekh, Lexington; John G. Groppo, Jr., Wilmore, both of Ky.

[73] Assignee: University of Kentucky Research Foundation, Lexington, Ky.

[21] Appl. No.: 560,055

[22] Filed: Jul. 27, 1990

[51] Int. Cl.[5] ..... B03D 1/04; B03D 1/14

[52] U.S. Cl. ..... 209/164; 209/166; 209/168; 209/170

[58] Field of Search ..... 209/164, 168, 169, 170, 209/166; 210/703, 704, 705, 706, 707

[56] References Cited

U.S. PATENT DOCUMENTS

| | | | |
|---|---|---|---|
| 2,778,499 | 1/1957 | Chamberlain | 209/170 |
| 3,175,687 | 3/1965 | Jones | 209/170 |
| 3,339,730 | 9/1967 | Boutin et al. . | |
| 3,428,175 | 2/1969 | Hukki | 209/170 |
| 3,959,131 | 5/1976 | Ramerez | 209/170 |
| 4,101,409 | 7/1978 | Austin | 209/168 |
| 4,477,338 | 10/1984 | Hellmann | 209/170 |
| 4,592,834 | 6/1986 | Yang . | |
| 4,639,313 | 1/1987 | Zipperian . | |
| 4,735,709 | 4/1988 | Zipperiam | 209/170 |
| 4,737,272 | 4/1988 | Szatkowski | 209/170 |
| 4,770,767 | 9/1988 | Hansen et al. . | |
| 4,851,036 | 7/1989 | Anthes | 209/170 |
| 4,964,576 | 10/1990 | Datta | 209/170 |
| 4,981,582 | 1/1991 | Yoon | 209/170 |

*Primary Examiner*—Stanley S. Silverman
*Assistant Examiner*—Thomas M. Lithgow
*Attorney, Agent, or Firm*—King & Schickli

[57] ABSTRACT

A froth flotation method and apparatus for the recovery of ultra-fine constituent are provided. The apparatus includes a flotation column having a drain for withdrawing tailings and underflow and an overflow for recovering the selected ultra-fine constituent. A mechanism is provided for delivering a wash medium to an upper portion of the column as well as for delivering diffuse air to a lower portion of the column. A slurry including the constituent to be recovered is received and conditioned within a tank that is connected by means of a feed line to the column. Additionally, a mechanism is provided for dissolving air in the slurry in the conditioning tank. Further, one or two matrixes may be mounted across the flotation column to further improve recovery. The method broadly includes the steps of (1) dissolving air in the slurry in the conditioning tank; (2) feeding the slurry through the feed line into an intermediate portion of the flotation column; (3) adding a reagent to the slurry that renders the selected constituent hydrophobic; (4) establishing and maintaining a downwardly flowing stream of wash medium in the flotation column; (5) establishing and maintaining an upwardly moving stream of diffuse air originating at a lower portion of the flotation column; and (6) recovering the selected ultra-fine constituent and diffuse air from the upper portion of the column.

5 Claims, 2 Drawing Sheets

FROTH FLOTATION METHOD FOR RECOVERY OF ULTRA-FINE CONSTITUENT

TECHNICAL FIELD

The present invention relates to an improved froth flotation method and apparatus for the recovery of a selected ultra-fine constituent, such as coal, that provides both enhanced recovery and grade.

BACKGROUND OF THE INVENTION

Coal water fuel has the potential to replace fuel oil. More particularly, in the future it is expected that high oil prices will make coal slurry fuels more competitive with and even preferable to foreign oil.

The majority of coal water fuel suppliers use a benefication technique to produce a low ash product. Typically, either physical or chemical coal cleaning techniques are utilized. Generally, however, physical coal cleaning techniques such as froth flotation or oil agglomeration are more economical than chemical leaching techniques. Of these two physical coal cleaning techniques, froth flotation appears to be the most economical and well established.

Froth flotation was first discovered in 1906. It was developed for the non-ferrous minerals industry to recover extremely fine, free minerals from slime. This technique, developed nearly 80 years ago, remains basically the same today. The froth flotation mechanism employs the principles of colloid chemistry, crystallography and physics. Separation of one mineral from another is achieved by the use of specific reagents and chemical conditions. The addition of chemical reagents makes one mineral surface hydrophobic through adsorption, while leaving the other mineral surfaces hydrophilic. The benefication is accomplished by sparging air through the suspension, whereby air bubbles laden with hydrophobic particles rise to the surface of the pulp or slurry, leaving behind the hydrophilic particles.

Froth flotation is a complex physico-chemico-mechanical process. The process and, particularly, bubble-particle attachment is influenced by many variables including pH, pulp or slurry density, particle size, bubble size and air flow.

There are two mechanisms proposed for explaining bubble-particle attachment in flotation. These mechanisms are (1) direct attachment by collision of particle and bubble and (2) precipitation of dissolved gas on hydrophobic particle surfaces. The collision mechanism has been verified using high speed photography and theoretical equations. The gas precipitation mechanism also has been demonstrated. Both mechanisms have attained worldwide recognition, however, the collision mechanism has been universally accepted over the bubble precipitation mechanism.

An example of a basic froth flotation apparatus is disclosed in U.S. Pat. No. 3,339,730 to Boutin et al. The Boutin froth flotation apparatus includes a column having upper, intermediate and lower sections. Initially, ground coal, oil, water and the necessary conditioning and flotation agents are added to and agitated in a conditioning tank. After conditioning, the resulting coal slurry or pulp is fed into the intermediate section of the column. A porous metal air diffuser is positioned in the bottom section of the column to provide air bubbles for floating the hydrophobic material which is then recovered through overflow from the top section of the column.

While relatively effective in separating coal from ash or tailings, the column of the type disclosed in the Boutin et al. patent may still be the subject of improvement to provide still more efficient and effective separation and enhanced recovery as well as grade. More particularly, the Boutin et al. apparatus essentially relies solely upon direct attachment by collision of particle and bubble for flotation. This mechanism is only effective for particles falling within a particular size fraction or range. Other, relatively smaller coal particles on the order of 21 $\mu$M are not effectively recovered. Accordingly, there is a significant loss of recoverable coal.

In an effort to address this shortcoming, flotation columns have also been equipped with packing or other structures specifically adapted to define a large number of flow passages extending in a circuitous or tortuous path between the upper and lower portions of the column. For example, U.S. Pat. No. 4,592,834 to Yang, discloses such a column wherein the packing consists of a plurality of spaced plates including uniformly spaced rows of corrugations. These spaced plates are specifically adapted to break individual bubbles into a number of bubbles of smaller size in an effort to increase the size fraction or range of coal with which the bubbles will interact so as to improve overall recovery. While relatively effective, froth flotation columns equipped with such packing may still be improved to provide yet more efficient and effective separation and enhanced recovery.

SUMMARY OF THE INVENTION

Accordingly, it is a primary object of the present invention to provide a froth flotation method and apparatus for the recovery of a selected ultra-fine constituent overcoming the above-described limitations and disadvantages of the prior art.

Another object of the present invention is to provide a froth flotation method and apparatus exhibiting improved efficiency of separation and enhanced recovery of coal or other selected constituent from ash and/or tailings.

Yet another object of the present invention is to provide a froth flotation method and apparatus furnishing a significant enhancement of not only recovery, that is, the ratio of solid material in the feed, but also grade, that is, the ratio of the desired constituent in the material recovered to the total material recovered.

Yet another object of the present invention is to provide an improved froth flotation method and apparatus particularly adapted for efficiently recovering coal of a broader-size, fraction or range.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved froth flotation method for the recovery of selected ultra-fine constituent utilizing an apparatus including a slurry conditioning tank, a feed line and a flotation column is provided. The method includes the initial step of dissolving air in an aqueous slurry (including the selected constituent) in the conditioning tank. Next is the step of feeding the slurry through the feed line into a median or intermediate portion of the flotation column. A reagent is added to the slurry to render the selected constituent hydrophobic to allow for recovery. Preferably, the reagent is added to the slurry in the feed line.

The method also includes the step of establishing and maintaining a downwardly flowing stream of wash medium in the flotation column. More particularly, the wash medium is introduced at an upper portion of the flotation column while wash medium laden with tailings is withdrawn from a lower portion of the flotation column. An additional step relates to the establishing and maintaining of an upwardly moving stream of diffuse air in the form of air bubbles originating at a lower portion of the flotation column. As the air bubbles collide with the selected constituent, that has already been rendered hydrophobic through reaction with the reagent prior to delivery to the flotation column, attachment is completed. The selected ultra-fine constituent then rises with the bubbles where it is recovered as overflow from the upper portion of the column.

More preferably, the method includes the step of pressurizing the slurry in the conditioning tank to substantially between 40 to 60 psig so as to dissolve an appropriate amount of air in the slurry. Upon subsequently introducing the slurry into the flotation column at ambient pressure, the dissolved air is released and actually precipitates on the hydrophobic particle surfaces. In particular, the dissolved air precipitates primarily on the relatively small particles of selected constituent having an average size of approximately 21 $\mu$M. In contrast, the air introduced at the lower portion of the flotation column through a diffuser collides with and provides effective recovery of relatively larger particles of selected constituent having an average size of approximately 34 $\mu$M. Together, the dissolved air and diffuse air serve to efficiently and effectively attach to particles over a broader size range so as to improve the overall recovery and grade of the selected constituent.

In accordance with yet another aspect of the present invention, the froth flotation method includes the step of providing a matrix in the upper portion of the flotation column. This matrix provides a tortuous path for the aqueous wash medium, the selected ultra-fine constituent and the rising diffuse air. The matrix also serves to spread the wash medium being introduced into the column over a larger area. Accordingly, more efficient washing and cleaning of ash and tailings is provided so that a purer product is recovered.

An additional matrix may also be provided in an intermediate portion of the flotation column. This matrix serves to significantly increase the opportunity for interaction between the diffuse air bubbles and hydrophobic selected constituent so as to improve overall recovery.

In accordance with yet another aspect of the present invention, a froth flotation apparatus for recovering a selected ultra-fine constituent is provided. The apparatus includes a flotation column having an upper froth zone, an intermediate cleaning zone and a lower recovery zone. The column also includes a drain adjacent the bottom wall for withdrawing tailings and underflow. An overflow is provided at the top of the column for recovering a selected ultra-fine constituent from the froth.

The column also includes means in the form of a conduit and spray head for delivering a wash medium to an upper portion of the column. Additionally, means are provided for delivering diffuse air to a lower portion of the column. More particularly, a source of air is connected by means of a conduit to a diffuser.

A conditioning tank is provided for receiving and conditioning an original slurry including the selected constituent. Five, ten and twenty percent pulp density suspensions or slurries may be prepared. A mechanism is provided in the conditioning tank to dissolve air into the slurry as previously described. An agitator may also be provided to increase the efficiency of this process. After a sufficient residence time, the slurry is transferred to the flotation column. More specifically, a feed line is provided for conveying the slurry from the conditioning tank to the intermediate portion of the flotation column where separation of the selected constituent from the tailing is undertaken.

A means such as a conduit and pump is also provided for adding reagent or reagents to the slurry in the feed line. The reagent(s) selected is (are) specifically adapted for rendering the selected constituent hydrophobic so that it will attach to the dissolved and diffused air in the column and rise for recovery at the overflow.

As indicated above, in order to improve and enhance the recovery and grade of the selected constituent, a matrix may be mounted across the flotation column (1) in the froth zone adjacent an upper portion of the column as well as (2) in the recovery zone adjacent a median portion of the column. Each matrix is formed by a series of lattice discs approximately 2 inches in diameter, spaced ¼ inch apart. The matrixes advantageously serve to maintain a smaller overall air bubble size for better interaction with the selected constituent and thus better coal recovery. The matrixes also serve to provide a tortuous pathway for the wash medium, selected ultra-fine constituent and diffuse air which serves to increase the residence time and hence the cleaning action. Accordingly, enhanced recovery and grade of selected constituent are provided.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention, and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
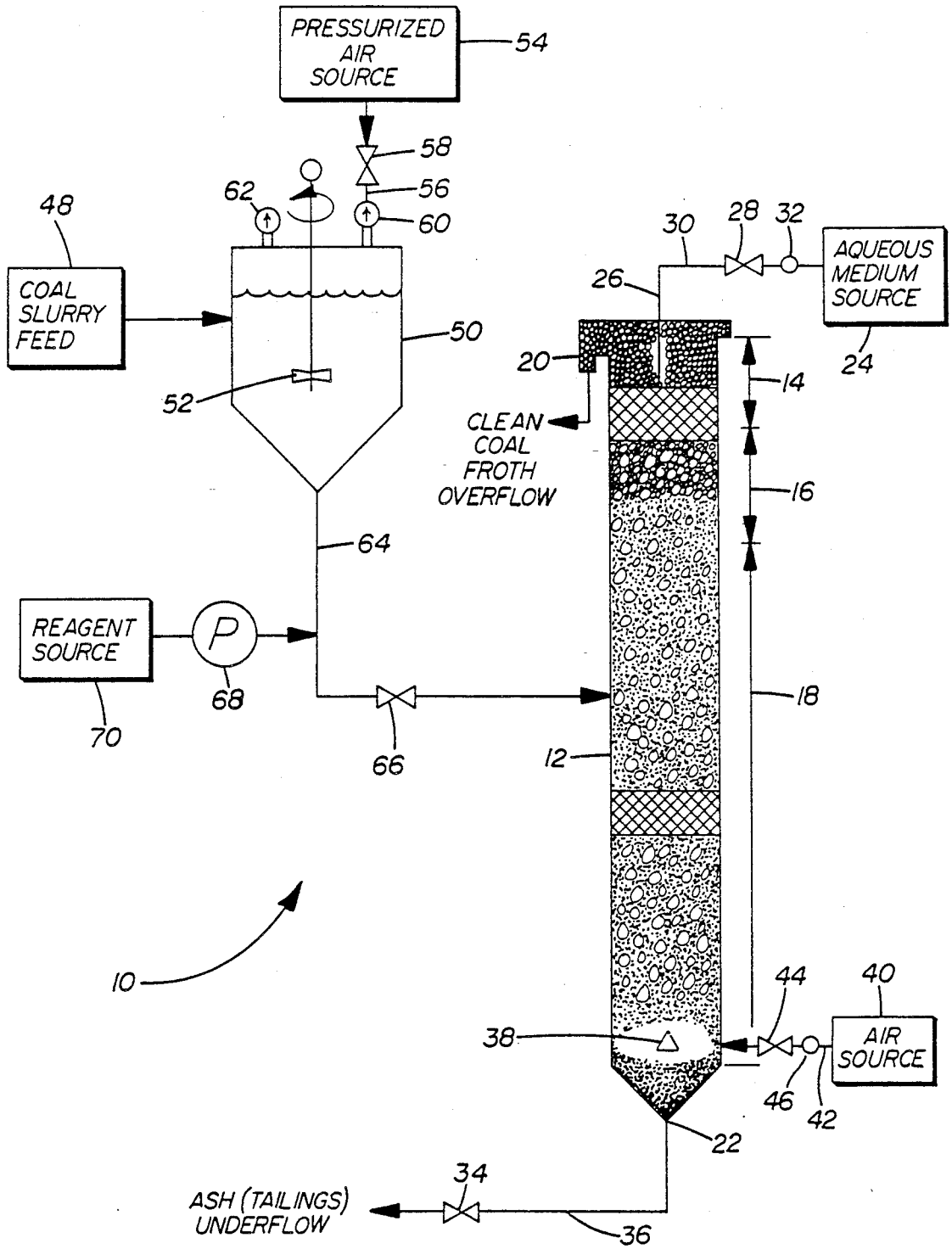
FIG. 1 is a schematical sectional view of the froth flotation apparatus of the present invention.

Reference is now made to FIG. 1 showing the froth flotation apparatus 10 of the present invention. As shown, the froth flotation apparatus 10 includes a flotation column 12. As is known in the art, the column 12 may have a circular, elliptical, square, rectangular or any other shape of cross section. Additionally, the length of the column should be greater than the width. Preferably, the column is constructed of lightweight, corrosion resistant material such as aluminum that presents a smooth inner surface to minimize turbulence.

The flotation column 12 includes a froth zone 14 adjacent an upper portion of the column, a cleaning zone 16 immediately underlying the froth zone 14 and a recovery zone 18 extending over intermediate and lower portions of the column 12. An overflow conduit 20 is provided at an upper end of the column 12. As described in greater detail below, the selected ultra-fine constituent to be recovered from the slurry is buoyed by air bubbles and moved through the overflow conduit 20. A drain 22 is provided at the lowermost end of the column 12. As also described in greater detail below, ash and tailings are withdrawn from the column from this drain 22. More particularly, these ash and tailings are conveyed in the wash medium being withdrawn through the drain 22 as underflow from the column 12.

A wash medium such as water is drawn from a source 24 and delivered through a spray inlet 26 into the upper end of the column 12. A valve 28 in the inlet line 30 allows the rate of flow of the wash medium to be controlled. A flow meter 32 in the line 30 allows confirmation of the rate of flow being provided at any given time. Preferably, the wash medium is introduced at a flow rate of approximately 0.02 to 0.5 gallons per minute depending upon the ultra-fine constituent to be recovered. For example, a flow rate of approximately 0.1 gallons per minute is preferred to wash certain coals such as Upper Freeport, Ill. No. 6 and Pittsburgh seam coals.

In order to maintain a consistent level of wash medium within the column 12 and provide the necessary downward flow, the control valve 34 in the drain line 36 is adjusted to provide an outflow from the column substantially matching the flow of wash medium into the column from the source 24. In this way, a downwardly flowing stream of wash medium in the flotation column 12 is both established and maintained.

An upwardly counterflowing stream of diffuse air bubbles is also established and maintained within the column 12. More particularly, an air diffuser 38 is positioned within the column 12 adjacent the lower portion near the drain 22. The diffuser 28 is fed from pressurized air source 40 through a feed line 42. A valve 44 in the feed line 42 allows adjustment of the rate of air flow. Of course, a flow meter 46 is also provided in the feed line 42 to provide an indication of the rate of flow at any given instant.

The rate of air flow, like the rate of wash medium flow does affect the recovery and grade of the selected ultra-fine constituent. Preferably, an air flow rate of between 0.01 and 0.15 cubic feet per minute is utilized. Where the ultra-fine constituent to be recovered is, for example, Pittsburgh, Upper Freeport or Ill. No. 6 seam coal, a flow rate of approximately 0.07 cubic feet per minute should be utilized. Such a rate substantially reduces impurities in the recovered coal.

While the apparatus 10 of the present invention may be utilized to selectively purify and collect any number of different ores, minerals or materials, it is particularly useful in the preparation of coal water fuel. In order to provide enhanced recovery and grade of ultra-fine coal, it is important that the coal be properly conditioned prior to being delivered into the column 12.

Initially, the coal is ground using, for example, a mill such as an Attritor Mill manufactured by Union Process of Akron, Ohio. More particularly, the coal is ground to a fine boiler grade with 80% passing 200 mesh size. A slurry or solid suspension of from 2 to 20% and preferably 5 to 10% coal is prepared and fed from a source 48 to a conditioning tank 50. A rotating impeller 52 driven by a motor (not shown) serves to agitate the slurry in the conditioning tank 50. During agitation, air from a pressurized air source 54 is admitted into the conditioning tank 50 through feed line 56 at a pressure controlled by the valve 58. The flow rate of air into the conditioning tank may be monitored by viewing the flow control valve 60. The pressure within the tank may be monitored by viewing the pressurization gauge 62. A pressure in the range of 20 to 80 and more preferably 40 to 60 psig is introduced into the conditioning tank 50 so as to dissolve air into the slurry. Once equilibrium is reached, the slurry is delivered through feed line 64 to the flotation column 12. A valve 66 in the feed line 64 allows the control of the rate of feed of slurry into the flotation column 12.

As the slurry moves through the feed line 64, reagents are added to the slurry that render the selected constituent to be recovered, in this case coal, hydrophobic. More particularly, reagents, known in the art for this purpose, are pumped by a pump 68 from a source 70 into the feed line 64 for mixing with the slurry. Preferably, the reagents utilized are fuel oil no. 2 and methyl isobutyl carbinol. The reagents are prepared as an oil-in-water type emulsion consisting of one part of reagents mixed with 100 parts of water. The amount of frother (methyl isobutyl carbinol) and fuel oil collector (fuel oil no. 2) utilized in the reagent mixture is influenced by a number of factors. These include the size and rank of coal to be floated as well as the degree of oxidation of the coal to be separated and recovered. Preferably, the frother and collector are employed in amounts which effect the greatest selectivity in recovery during flotation. Such amounts may be determined by persons skilled in the art. Similarly, the amount of oil-in-water emulsion to be added to the slurry running through the feed line 64 may also be determined. For example, for most applications between approximately 0.01 and 1.00 lb of methyl isobutyl carbinol and 0.10 and 1.50 lb of fuel oil no. 2 are required per ton of coal.

The treated and conditioned coal slurry is delivered into the flotation column 12 at atmospheric pressure at an intermediate portion of the column. The drop in pressure from that provided in the conditioning tank 50 causes the air dissolved in the slurry to precipitate onto the ultra-fine particles of coal which have been made hydrophobic by treatment with the oil-in-water emulsion including the appropriate reagents. More specifically, it has been found that the dissolved air is very effective in floating and hence in the recovery of ultra-fine particles of coal averaging 21 μM in size. Accordingly, these relatively small coal particles float upward from the recovery zone 18 through the cleaning zone 16 toward the froth zone 14 for eventual recovery through the overflow conduit 20. In contrast, the relatively larger and heavier coal particles along with other ash and tailings are drawn downwardly with the flow of the wash medium through the column 12 from the inlet 26 to the drain 22. As the relatively larger coal particles, having a size averaging approximately 34 uM, move downwardly in the column 12, they collide with air bubbles from the diffuser 38. Since the coal particles have been rendered hydrophobic by the addition of the oil-in-water reagent emulsion in the feed line 64, the colliding air bubbles become attached to the coal particles which then rise upwardly in the column 12 against the downward flow of the wash medium. Thus, these relatively larger particles are also drawn by the air bubbles upwardly through the recovery, cleaning and froth zones 18, 16 and 14 for recovery through the overflow 20. In contrast, the ash and tailings which are not rendered hydrophobic continue to be drawn downwardly through the column 12 with the wash medium until withdrawn from the column through the drain 22.

In order to further improve the efficiency of separation and enhance both recovery and grade of coal, it has been found desirable to position a matrix 72, extending across the entire opening of the column 12, at a median portion of the column in the recovery zone 18. This matrix 72 provides a tortuous pathway for the wash medium, selected ultra-fine constituent and diffuse air which effectively serves to increase the residence time in the column and hence the separation efficiency. Accordingly, better separation and enhanced recovery result.

Further, an additional matrix 72 of the same type may be positioned adjacent an upper portion of the column 12 in the froth zone 14. This matrix 72 serves to increase the residence time of the particle laden froth at the top of the column 12 where it is subjected to the wash medium spray being introduced into the column. This matrix 72 also serves to spread the spray over a larger area. Together, these advantages lead to improved cleaning of tailings and ash from the selected constituent held in the froth and hence, enhance grade.

Figure 2:
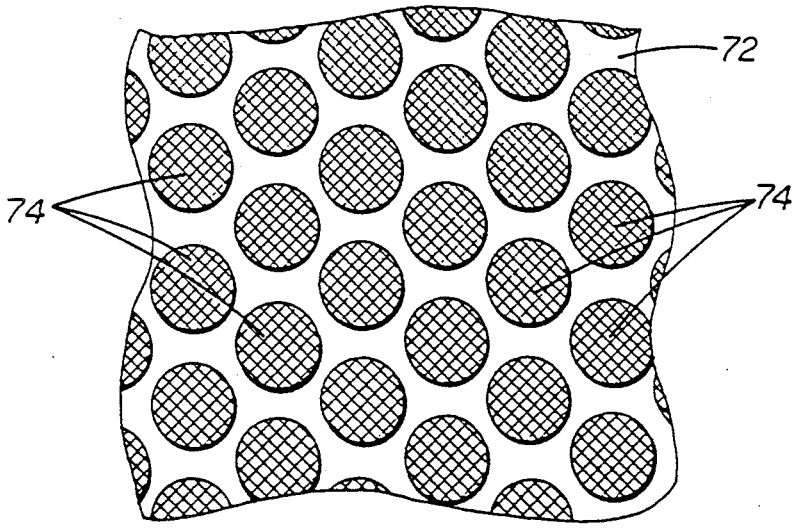
FIG. 2 is a detailed fragmentary plan view of a matrix of the type positioned in the froth flotation column in accordance with the teachings of the present invention.
Figure 3:
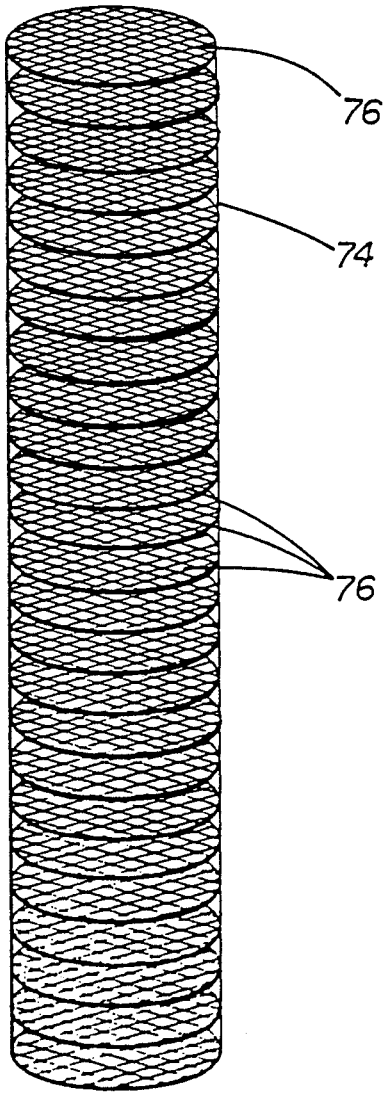
FIG. 3 is a detailed perspective view of a treatment cylinder of the type provided in the matrix shown in FIG. 2.

Preferably, the matrixes 72 are formed from a corrosion resistant material such as plastic or aluminum. As best shown in FIGS. 2 and 3, each matrix 72 comprises a series of treatment cylinders 74 held in a framework in aligned rows and columns. Each cylinder 74 comprises a series of aligned lattice discs 76 having a diameter of approximately 2 inches with each disc spaced ¼ inch apart. Preferably, each cylinder 74 is at least six inches tall. Advantageously, the criss-crossing lattice structure serves to maintain a smaller overall air bubble size by breaking larger air bubbles into multiple smaller bubbles. This allows better attachment through bubble/particle collision in the recovery zone 18 and hence more effective recovery.

Briefly summarizing, the froth flotation method for the recovery of selected ultra-fine constituent utilizing the apparatus 10 described above, includes the step of dissolving air in the slurry in the conditioning tank. Next is the feeding of the slurry from the conditioning tank through a feed line into an intermediate portion of the flotation column 12. Reagent is added to the slurry that renders the selected constituent hydrophobic. As described, the reagent is added to the slurry in the feed line.

As also described, the method includes the step of establishing and maintaining a downwardly flowing stream of wash medium in the flotation column 12 with the wash medium being introduced at an upper portion of the column. Further, the method includes the step of establishing and maintaining an upwardly moving stream of diffuse air originating at a lower portion of the flotation column 12. Finally, the method also includes the step of recovering the selected ultra-fine constituent and diffuse air from the upper portion of the column 12. In contrast, tailings and wash medium are withdrawn from a lower portion of the column 12.

In summary, numerous benefits have been described which result from employing the concepts of the present invention. Advantageously, the apparatus and method of the present invention provide for improved efficiency of separation and enhanced recovery and grade of a selected ultra-fine constituent.

The foregoing description of a preferred embodiment of the invention has been presented for purposes of illustration and description. It is not intended to be exhaustive or to limit the invention to the precise form disclosed. Obvious modifications and variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

We claim:

1. A froth flotation method for the recovery of a selected ultra-fine constituent utilizing an apparatus including a pressurized air source, a slurry conditioning tank, a feed line and a flotation column, comprising the steps of:

dissolving air in said slurry in said conditioning tank in the absence of flotation reagent by admitting air from said pressurized air source at a pressure above atmospheric pressure;

feeding said slurry with dissolved air through said feed line;

adding a flotation reagent to said slurry to render said selected constituent hydrophobic, said flotation reagent being added only after the dissolving of air in said slurry is completed;

delivering said slurry with dissolved air and flotation reagent into said flotation column at atmospheric pressure;

establishing and maintaining a downwardly flowing stream of wash medium in said flotation column, said wash medium being introduced at an upper portion of said flotation column;

establishing and maintaining an upwardly moving stream of diffuse air originating at a lower portion of said flotation column;

providing a matrix in said upper portion of the flotation column so as to provide a tortuous path for said wash medium, selected ultra-fine constituent and diffuse air; and recovering said selected ultra-fine constituent from said upper portion of said column.

2. The froth flotation method set forth in claim 1, wherein said flotation reagent is added to said slurry only in said feed line.

3. The froth flotation method set forth in claim 1, further including pressurizing said slurry in said conditioning tank to substantially between 20 to 80 psig to dissolve air in said slurry.

4. The froth flotation method set forth in claim 1, further including providing a matrix in said intermediate portion of said flotation column so as to provide a tortuous path for said wash medium, selected ultra-fine constituent and diffuse air.

5. The froth flotation method set forth in claim 1, further including withdrawing tailings and wash medium from a lower portion of said column.

* * * * *